US006561435B2

(12) United States Patent
Kluegl

(10) Patent No.: US 6,561,435 B2
(45) Date of Patent: May 13, 2003

(54) INJECTOR FOR AN INJECTION SYSTEM OF AN INTERNAL COMBUSTION ENGINE

(75) Inventor: Wendelin Kluegl, Seubersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/922,896

(22) Filed: Aug. 6, 2001

(65) Prior Publication Data

US 2001/0054652 A1 Dec. 27, 2001

Related U.S. Application Data

(63) Continuation of application No. PCT/DE00/00469, filed on Feb. 18, 2000.

(51) Int. Cl.[7] ..... F02M 47/02; F02M 59/00; F02M 63/00; B05B 1/14; B05B 1/30

(52) U.S. Cl. ..... 239/88; 239/91; 239/533.2; 239/533.3; 239/533.9; 239/585.4

(58) Field of Search ..... 239/88, 91, 110, 239/119, 124, 533.2, 533.3, 533.7, 533.9, 569, 585.1, 585.2, 585.3, 585.4, 585.5, 584, 93; 123/468, 470

(56) References Cited

U.S. PATENT DOCUMENTS

| | | | | | |
|---|---|---|---|---|---|
| 2,445,269 | A | | 7/1948 | Hoffer | 210/164 |
| 4,408,718 | A | * | 10/1983 | Wich | 239/88 |
| 5,033,442 | A | * | 7/1991 | Perr et al. | 123/502 |
| 5,127,584 | A | * | 7/1992 | Sczomak | 239/533.11 |
| 5,413,281 | A | * | 5/1995 | Hofmann et al. | 239/533.4 |
| 5,609,134 | A | * | 3/1997 | Schmidt et al. | 123/322 |
| 5,779,149 | A | * | 7/1998 | Hayes, Jr. | 239/124 |

FOREIGN PATENT DOCUMENTS

| | | |
|---|---|---|
| DE | 19802495 | 12/1998 |
| EP | 0262539 | 4/1988 |
| EP | 0949415 | 10/1999 |
| GB | 2316447 | 2/1998 |

* cited by examiner

*Primary Examiner*—Michael Mar
*Assistant Examiner*—Davis Hwu
(74) *Attorney, Agent, or Firm*—Baker Botts L.L.P.

(57) ABSTRACT

An injector for an injection system of an internal combustion engine, with an injector head (1), a nozzle (13) for injecting fuel, a control unit (12) for controlling the transfer of fuel from the injector head (1) to the nozzle (13) and an actuator (6) for the mechanical activation of the control unit (12) in order to control fuel injection, an injector housing (2), which receives at least the control unit (12), being integrally formed on the injector head (1) at the bottom.

16 Claims, 2 Drawing Sheets

INJECTOR FOR AN INJECTION SYSTEM OF AN INTERNAL COMBUSTION ENGINE

This is a continuation of copending application Ser. No. PCT/DE00/00469 filed Feb. 18, 2000, PCT Publication WO 00/50761, which claims the priority of DE 199 07 544.1 filed Feb. 22, 1999.

FIELD OF THE INVENTION

The invention relates to an injector for an injection system of an internal combustion engine.

BACKGROUND OF THE INVENTION

Conventional injectors for injecting fuel into internal combustion engines are generally constructed in a modular manner and consist of a plurality of parts, such as an injector body and a control module which are arranged one above the other with the mechanical connection of two axially adjacent parts being made by means of a connecting element, such as a clamping sleeve, a double clamping nut or a welded sleeve.

The injector is normally fastened in the cylinder head of the internal combustion engine which presses the injector axially into a corresponding receiving bore in the cylinder head. The clamping claw resting on a cylindrical collar which is integrally formed peripherally on the outside of the injector. To prevent the injector from being rotated about its longitudinal axis, key surfaces, which the clamping claw engages, are integrally formed on the outer surface of the injector.

In prior art injectors the cylindrical collar and the key surfaces are fastened either directly to the injector head or to a hollow-cylindrical union nut which receives the individual parts of the injector and is connected on its top side to the injector head. One disadvantage of these injectors is the multiplicity of parts which makes the manufacture and assembly of the injector relatively complicated.

Accordingly, an object of the present invention is to provide an injector for an injection system of an internal combustion engine, wherein the manufacture and assembly of the injector is simplified.

SUMMARY OF THE INVENTION

One aspect of the present invention is the utilization of an injector housing which is formed essentially in one piece and which merges at the top into the injector head. The housing is designed to receive at least the control unit. Preferably, the injector housing receives a plurality of injector modules and braces these modules axially relative to one another, in order to effect a high-pressure seal at the joints between adjacent modules.

By using a common housing for the essential components of the injector, separate connection means, such as clamping sleeves, double clamping nuts or welded sleeves, for connecting the individual parts may be dispensed with since the individual parts of the injector are already mechanically fixed by means of the common housing. Furthermore, use of the common injector housing reduces the number of high-pressure sealing surfaces which could result in leaks to the outside.

In accordance with the present invention, it is not necessary for the injector housing to receive all components of the injector and connect them to one another. For example, it is possible for the nozzle body on the underside of the injector to be attached to the injector housing via a conventional clamping nut, while the remaining components of the injector, such as the control unit, are located in the injector housing.

Another aspect of the present invention contemplates omitting a separate transmission lever for transmitting the actuating movement of the actuator to the valve piston, with the actuator acting directly on the valve piston. By doing away with one component of the injector, the outlay in terms of manufacture and assembly is further reduced. Furthermore, by dispensing with a conventional transmission lever, the durability of the injector is increased, since the useful life of such a transmission lever is problematic.

Due to a reduced surface pressure, the bearing surface between the actuator and the valve piston has a liquid film between the actuator and the valve piston, even during a switching operation, and thus effects an hydraulic play compensation. The mutually confronting end faces of the actuator and/or the valve piston are preferably convexly shaped, in order to prevent the liquid film from breaking away under mechanical load during a switching operation. However, the end faces may also be completely planar, thus allowing simple length adjustment by measurement and grinding down.

A spring is preferably arranged between the actuator and the valve piston which presses the actuator and the valve piston apart in the axial direction. This feature also provides full play compensation when the injector is in the rest state. Such a spring advantageously enables thermal expansions to be compensated for.

In a further variation of the present invention, the valve piston of the injector is not guided directly in the injector housing, but is mounted in a separate valve housing which is arranged within the injector housing. This affords the advantage that the valve seat of the valve piston is located in a valve housing, not in the injector housing. This eliminates the need for any complicated heat treatment of the entire injector housing.

In another aspect of the present invention, a continuous leakage line is omitted and the central bore for the control members is used for leakage return from the nozzle to the control unit. The leakage line is connected to the central bore preferably by means of a radial connecting bore. Above the control unit, leakage is carried via a separate line. This aspect of the present invention further improves injector manufacturing efficiencies.

The injector according to the present invention is preferably used in a common-rail injection system, although the invention is not restricted to that use, and, in principle, may be used in other types of injection systems.

DRAWINGS

Other advantageous features of the present invention are disclosed in more detail below in the context of a preferred embodiment of the invention, together with reference to the figures in which.

DETAILED DESCRIPTION OF THE INVENTION

Figure 1:
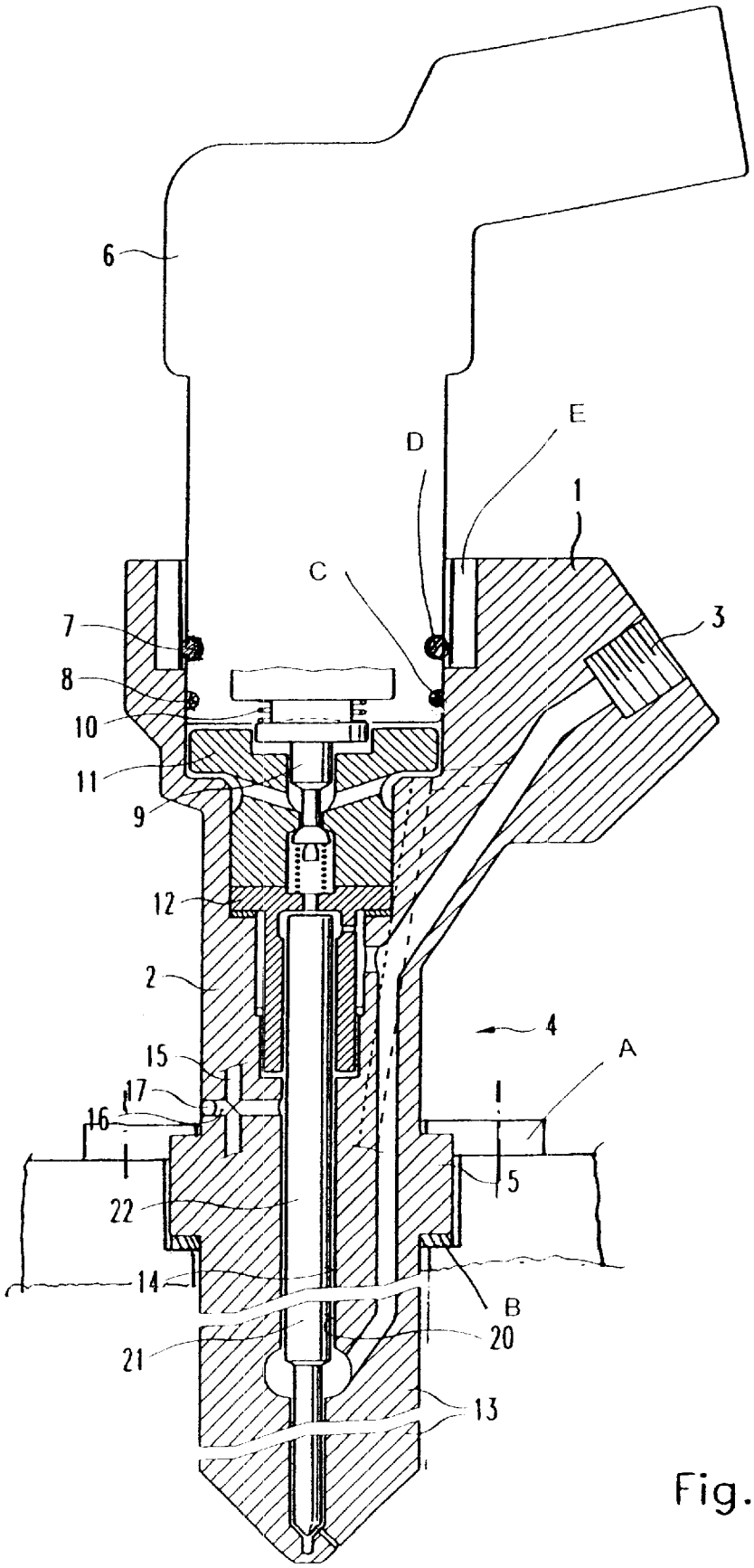
FIG. 1 shows the cross section of the head region of an injector.

The injector shown in FIG. 1 has a modular construction and serves to inject fuel into a combustion space of an internal combustion engine. On the top side of the injector is an injector head 1 which merges smoothly on the underside into a common injector housing 2, so that the essential components of the injector are fixed mechanically by means of the common injector housing 2.

The injector head 1 is beveled on its top side and provided with a screw connection 3 having an internal thread which receives the endpiece of an injection line which connects the injector to a central injection system so as to provide the necessary injection pressure for all the cylinders of the internal combustion engine.

On the underside of the injector head 1 is an essentially cylindrical body part, on which key surfaces 4 are integrally formed below the bevel which together with a peripheral cylindrical collar 5 allow the engagement of a clamping claw A. The clamping claw A presses axially from above into the peripheral collar 5, with the result that the entire injector is pressed axially downward into a corresponding receiving bore in the cylinder head of the internal combustion engine. A copper disk B is arranged between the lower end face of the injector and the bottom face of the receiving bore, in order to seal the receiving bore. The clamping claw A also engages the key surfaces 4 laterally and, in the mounted state, prevents the injector from being rotated about its longitudinal axis.

The top side of the injector has a centrally arranged cylindrical bore for receiving an actuator 6. Two cylindrically peripheral grooves 7, 8 are arranged one above the other on the outer bottom surface of the actuator 6. In the mounted state, the lower groove 8 has an O-ring C which seals the annular gap between the actuator 6 and the bore in the injector head 1. In contrast, in the mounted state, a wire ring D is arranged in the upper groove 7. The wire ring makes it possible to fasten the actuator 6 in the injector head 1 via a hollow screw E. The actuator 6 has an axial actuating movement in order to control fuel injection and 6 acts directly on a valve piston 9, without using i.e. transmission levers that are mechanical intermediate members found in conventional injectors. This arrangement thus affords the advantage that one component can be dispensed with, with the result that the outlay in terms of manufacture and assembly is reduced. Furthermore, the useful life and reliability of the injector are increased, since the useful life of transmission levers are problematic.

Figure 2:
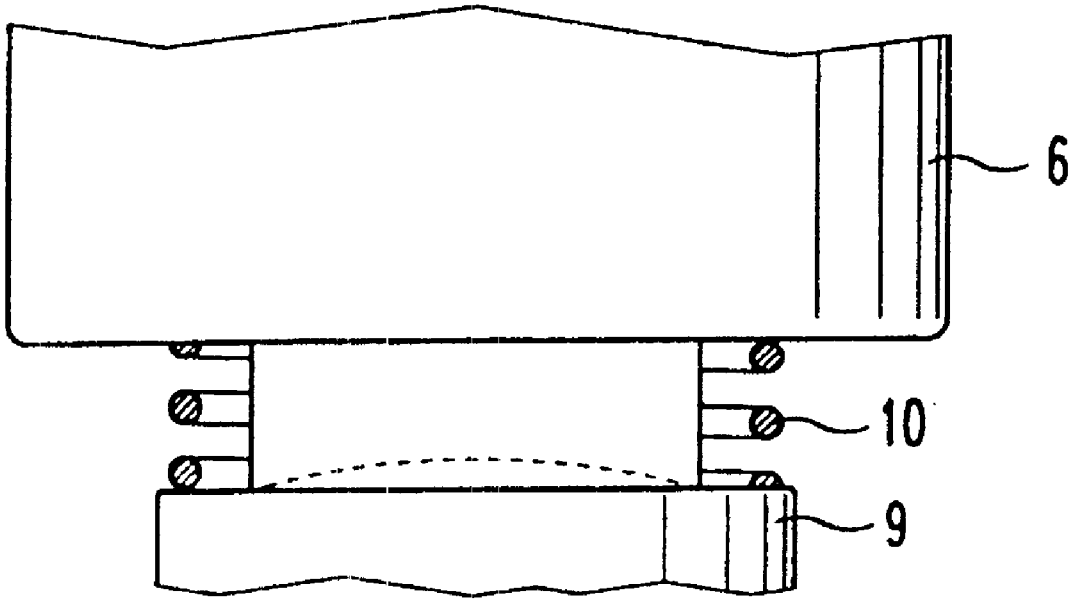
FIG. 2 shows, in cross section, detail of the contact point between the actuator and the valve piston of the injector illustrated in FIG. 1.

The bearing surface between the lower end face of the actuator 6 and the upper end face of the valve piston 9 is substantially larger than that of conventional injectors. This enables a liquid film to remain between the actuator 6 and the valve piston 9, even during an injector switching operation, with the result that hydraulic play compensation takes place. The lower end face of the actuator 6 has a slight convex shape. This is shown in FIG. 2. The liquid film is thereby prevented from breaking away at the contact surface between the actuator 6 and the valve piston 9 when mechanical loads occur during a switching operation. Alternatively, the upper end face of the valve piston 9 may also have a convex shape.

A spring 10 is arranged between the actuator 6 and the valve piston 9. Spring 10 presses the actuator 6 and the valve piston 9 axially apart and thus restores full axial play compensation when the injector is in the state of rest. Furthermore, the spring 10 compensates for the thermal expansions of the individual components.

A separate valve housing 11 for guiding the valve piston 9 is inserted into the injector housing 2. The valve seat for the valve piston 9 is located in the valve housing 11, and not in the common injector housing 2 and thus complicated heat treatment of the entire injector housing 2 (for hardening the valve seat) can be omitted since it is only necessary to harden the valve housing 11.

A control unit 12 with a servovalve is arranged below the valve piston 9. The actuator 6 actuates the servovalve via the valve piston 9 and consequently indirectly controls the position of a nozzle needle 21 in the guide bore 20 of a nozzle 13 and thereby controls the fuel stream which is injected into the combustion space of the internal combustion engine via nozzle 13 of the injector. The nozzle 13 which is schematically illustrated may be connected to the injector housing 2 via a conventional clamping nut. This connection means has been omitted in the drawing simply for the sake of clarity.

As illustrated, the injector has a particularly advantageous form of leakage return. Instead of an additional leakage line extending essentially continuously over the entire length of the injector, central bore 14, in which a piston 22 acting upon on the nozzle needle 21 is arranged axially, is used for leakage return. The outlay in terms of the manufacture of the injector according to the present invention is thereby reduced further. Although the injector as illustrated has a leakage line 15 running axially, it extends only from the top to below the control unit 12, where the leakage line 15 connects to the central bore 14. The connection of the leakage line 15 to the central bore 14 is made by means of a radial bore 16 which, at the point of connection with the leakage line 15, extends from the outer cylindrical surface of the injector housing 2 inward to the central bore 14. The leakage line 15 is chamfered, in order to allow the ingress of leakage liquid from the central bore 14 into the leakage line 15. Since bore runs 16 radially inward from the outer surface of the injector housing 2, it requires the outer orifice to be sealed by means of a ball 17. Nevertheless, this is substantially simpler in manufacturing terms than other structural possibilities to enable the leakage line 15 to issue into the central bore 14.

When the injector of the present invention is being assembled, the control unit 12, together with the servovalve, the valve housing 11 and the valve piston 9, are inserted into the injector housing 2. Thereupon, the axial position of the valve piston 9 relative to the actuator 6 is set, in that the length of the valve piston 9 is determined, for example, by measurement and grinding.

The present invention is not to be limited to its implementation in the preferred exemplary embodiments disclosed above. A number of variations will be understood by those skilled in the art, even in versions of a fundamentally different nature.

I claim:

1. An injector for an injection system of an internal combustion engine, comprising an injector head, a nozzle for injecting fuel into a combustion space in the internal combustion engine, a control unit for controlling the transfer of fuel from the injector head to the nozzle and an actuator for the mechanical activation of the control unit in order to control fuel injection, further comprising an injector housing, for housing at least the control unit, said housing being integrally formed in one piece on the injector head, and wherein the actuator acts directly on a valve piston such that contacting surfaces of the actuator and valve piston retain a liquid film there between during a switching operation wherein the contacting surfaces of the actuator and/or valve piston convex.

2. The injector according to claim 1, wherein a spring is arranged between the actuator and the valve piston.

3. The injector according to claim 1, wherein the valve piston is located in a separate valve housing within the injector housing seat.

4. The injector according to claim 1, wherein a peripheral collar is integrally formed on the outer surface of the injector housing to support a clamping claw for bracing the injector axially in a receiving bore in the cylinder head of the internal combustion engine.

5. The injector according to claim 1, wherein key surfaces are integrally formed on the outer surface of the injector housing for engagement of a clamping claw, so as, to prevent the injector from being rotated in the mounted state.

6. The injector according to claim 1, further comprising a substantially axially aligned leakage line, which opens below the control unit to a central bore which receives a control rod and serves as a leakage return line.

7. The injector according to claim 6, wherein the injector housing is formed with a substantially radial bore to connect the leakage line to the central bore, wherein an outer orifice of the radial bore is closed in the mounted state.

8. The injector according to claim 7, wherein the outer orifice of the radial bore is closed by means of a ball in the mounted state.

9. An injector for an injection system of an internal combustion engine, comprising an injector head, a nozzle for injecting fuel into a combustion space in the internal combustion engine, a control unit for controlling the transfer of fuel from the injector head to the nozzle and an actuator for the mechanical activation of the control unit in order to control fuel injection, further comprising an injector housing, for housing at least the control unit, said housing being integrally formed in one piece on the injector head, and wherein the actuator acts directly on a valve piston such that contacting surfaces of the actuator and valve piston retain a liquid film there between during a switching operation wherein the valve piston is located in a separate valve housing within the injector housing seat.

10. The injector according to claim 9, wherein the contacting surfaces of the actuator and/or valve piston are convex.

11. The injector according to claim 9, wherein a spring is arranged between the actuator and the valve piston.

12. The injector according to claim 9, wherein a peripheral collar is integrally formed on the outer surface of the injector housing to support a clamping claw for bracing the injector axially in a receiving bore in the cylinder head of the internal combustion engine.

13. The injector according to claim 9, wherein key surfaces are integrally formed on the outer surface of the injector housing for engagement of a clamping claw, so as, to prevent the injector from being rotated in the mounted state.

14. The injector according to claim 9, further comprising a substantially axially aligned leakage line, which opens below the control unit to a central bore which receives a control rod and serves as a leakage return line.

15. The injector according to claim 14, wherein the injector housing is formed with a substantially radial bore to connect the leakage line to the central bore, wherein an outer orifice of the radial bore is closed in the mounted state.

16. The injector according to claim 15, wherein the outer orifice of the radial bore is closed by means of a ball in the mounted state.

* * * * *